US008341782B2

(12) United States Patent
Abrahams

(10) Patent No.: US 8,341,782 B2
(45) Date of Patent: Jan. 1, 2013

(54) BABY SUPPORT DEVICE

(75) Inventor: Geraldine Abrahams, Glasgow (GB)

(73) Assignee: TWM Productions Ltd., Glasgow (GB)

( * ) Notice: Subject to any disclaimer, the term of this patent is extended or adjusted under 35 U.S.C. 154(b) by 4 days.

(21) Appl. No.: 13/054,531

(22) PCT Filed: Jul. 16, 2009

(86) PCT No.: PCT/GB2009/001755

§ 371 (c)(1),
(2), (4) Date: Apr. 14, 2011

(87) PCT Pub. No.: WO2010/007370

PCT Pub. Date: Jan. 21, 2010

(65) Prior Publication Data

US 2011/0296618 A1 Dec. 8, 2011

(30) Foreign Application Priority Data

Jul. 16, 2008 (GB) ..... 0812954.6

(51) Int. Cl.
*A47D 9/00* (2006.01)
*A47D 11/00* (2006.01)

(52) U.S. Cl. ..... 5/655; 5/633; 5/731; 297/452.11; 297/452.17

(58) Field of Classification Search ..... 5/101, 655, 5/632, 731–735, 630, 633; 297/250.1, 452.11, 297/452.12, 452.16, 452.17
See application file for complete search history.

(56) References Cited

U.S. PATENT DOCUMENTS

| | | | | |
|---|---|---|---|---|
| 2,281,629 | A | 5/1942 | Snow | |
| 3,733,104 | A * | 5/1973 | Carstensen | 297/377 |
| 4,566,449 | A | 1/1986 | Smith | |
| 5,440,770 | A * | 8/1995 | Nichols | 5/655 |
| 5,448,790 | A * | 9/1995 | Saro et al. | 5/657 |
| 5,700,059 | A * | 12/1997 | Moscot | 297/452.17 |
| 5,957,537 | A | 9/1999 | Hoolahan | |
| 6,922,861 | B1 | 8/2005 | Mathis | |
| 6,925,669 | B1 | 8/2005 | Friedman et al. | |
| 7,107,639 | B2 * | 9/2006 | Taricani | 5/655 |
| 7,350,253 | B2 * | 4/2008 | Simon | 5/655 |

(Continued)

FOREIGN PATENT DOCUMENTS

DE 296 17 625 U1 1/1997

(Continued)

OTHER PUBLICATIONS

PCT International Preliminary Report on Patentability and Written Opinion, PCT Application No. PCT/GB2009/001755, Jan. 18, 2011, five pages.

(Continued)

*Primary Examiner* — Michael Trettel
(74) *Attorney, Agent, or Firm* — Fenwick & West LLP

(57) ABSTRACT

A baby support device is described. The baby support device comprises an elongate first surface adapted to support all or part of a baby and a shorter second surface adapted to support at least part of a baby, the first and second surfaces being arranged at an angle with respect to one another such that the first surface alone or the first and second surfaces together can, in use, fully support a baby in both the prone or supine orientations.

40 Claims, 8 Drawing Sheets

U.S. PATENT DOCUMENTS

| | | | | |
|---|---|---|---|---|
| 7,930,784 | B2 * | 4/2011 | Jew et al. | 5/731 |
| 2005/0278857 | A1 | 12/2005 | Fairchild et al. | |
| 2006/0070185 | A1 | 4/2006 | Rubio | |

FOREIGN PATENT DOCUMENTS

| | | | |
|---|---|---|---|
| EP | 0 051 162 | A | 5/1982 |
| WO | WO 2005/110162 | | 11/2005 |

OTHER PUBLICATIONS

PCT International Search Report, PCT/GB2009/001755, Sep. 29, 2009, 3 Pages.

United Kingdom Intellectual Property Office, Examination Report, UK Patent Application No. GB 1101421.4, Nov. 23, 2011, two pages.

* cited by examiner

BABY SUPPORT DEVICE

FIELD OF THE INVENTION

This invention relates to a baby support device.

BACKGROUND TO THE INVENTION

In recent times there has been a recognition that it is essential for the physical, emotional and social development of a baby to spend time on its tummy.

Over the past twenty-five years there has been a drastic drop in the time that a baby spends on its tummy (known as "tummy time"). This drop in tummy time has largely been as a result of increased knowledge of, or worry about, Sudden Infant Death Syndrome. Much of the medical advice in connection with this syndrome over that period is to lay babies on their backs whilst sleeping to prevent potential smothering. It is believed this advice has been taken literally and parents have been afraid to place babies on their fronts or tummies, even when awake and being monitored.

An unpleasant consequence of this drop in tummy time has been an increase in the occurrence of plagiocephaly or "flat head".

As a result of this drop, tummy time is now encouraged all over the world. Tummy time is known to improve the physical, mental, emotional and social development of infants. It is believed tummy time improves the infant's digestive system due to the position of the spine in the prone position.

Currently, most of the devices on the market, which are intended to encourage tummy time, are floor-based mats and the like. As they are floor-based, the baby on the mat spends the entire time at ground level looking at people's feet and as a result can become frustrated and refuse to lift their heads because they feel disorientated, insecure and abandoned, especially in the very early months.

SUMMARY OF THE INVENTION

According to an aspect of the present invention, there is provided a baby support device comprising:

an elongate first surface adapted to support all or part of a baby; and a shorter second surface adapted to support at least part of a baby, the first and second surfaces being arranged at an angle with respect to one another such that the first surface alone or the first and second surfaces together can, in use, fully support a baby in both the prone or supine orientations.

In one embodiment, the present invention provides a baby support device which encourages, and provides a safe and secure environment for tummy time. Providing surfaces on which the baby can be fully supported, in all orientations permits the baby to maximise their tummy time by providing a surface against which the baby can kick their feet. By fully supported it is meant that the whole of the baby's body, including the legs and feet, is supported. Particularly when a baby is on his tummy, the baby is supported so that their feet do not hang off an end and they can kick their feet against one of the surfaces to strengthen their leg muscles and help increase the density of the bones.

Preferably, the first and second surfaces are arranged at approximately 110° to one another. A support device of this shape emulates the sitting position. A device of this shape permits the carer or parent to face the baby so that they can comfort, bond with or play with the baby using a variety of stimuli. The positions which the baby can adopt on a device of this shape assists in strengthening the baby's neck, shoulders or back and helps develop the baby's motor and sensory skills, and emotional & mental wellbeing.

In one embodiment, the first and second surfaces are arranged at between 110° and 120° to one another.

Preferably, the elongate first surface is angled at approximately 20° to the horizontal and the shorter second surface is angled at approximately 50° to the horizontal. The steeper incline provided by the second surface acts as a buffer for the babies when they are lying on the first surface in the prone position, facing away from the second surface, allowing them to kick against the second surface and strengthen their leg muscles. It is important that the second surface is of sufficient length that, when in this position, the baby can kick against the second surface. The inclined first surface allows babies to see everything in the room more easily and positions them for excellent eye contact and communication with their parents or carers.

Preferably, the first and second surfaces comprise a wipe-clean material.

Preferably, the device comprises a body.

Preferably, the body defines the first and second surfaces.

Preferably, the device further comprises a frame.

Preferably, the frame is adapted to support the body.

The body may be releasably connectable to the frame. Releasably connecting the body to the frame permits the body to be removed from the frame for cleaning for example.

Preferably, the body is washable.

Preferably, the device further includes a frame support.

Preferably, the frame support is adapted to receive the frame.

Preferably, the frame support is adapted to releasably support the frame.

Preferably, the frame support is adapted to releasably support the frame in a first position in which the device is stable or in a second position in which the device is adapted to rock.

Preferably, in the first and/or second positions the frame is releasably lockable with respect to the frame support.

Preferably, in the second position the frame support is inverted with respect to the first position.

Preferably, the device incorporates a first and second side. The first and second sides are provided to prevent the baby rolling-off the device.

Preferably, the sides are integral with the device body.

Preferably, the device further incorporates a harness. The harness can be provided to permit the baby to be strapped into a device.

The harness may encircle the baby and be fixed to the device.

Alternatively, the harness may be arranged such that, in use, the baby is sandwiched between the harness and the body.

Preferably, the device further comprises a mat. A mat is provided to keep the first and second surfaces clean.

Preferably, the mat is padded.

The mat may comprise a wipe clean material.

Alternatively or additionally the mat may be washable.

The device body may comprise a core material contained within a fabric layer.

The core may comprise a plastic sheet. The sheet may be polypropylene.

Beneath the first and second surfaces the core may be coated with a cushioned material The cushioned material may be foam.

The fabric layer may comprise cotton.

The device body may be collapsible.

The device body may be movable between a flat configuration and an erected configuration.

The device body may be movable between a flat configuration and a folded configuration. The folded configuration permits the device body to be stored whilst occupying minimal amounts of space.

The device body may be movable between a folded configuration and an erected configuration, such that when moving between the folded and erected configurations the device body adopts a flat configuration.

The device body may define at least one first edge and at least one second edge.

In one embodiment one of said first edges is releasably connectable to one of said second edges by a releasable connector.

The edges may be releasably connectable by means of a zip.

Alternatively or additionally, the edges may be releasably connectable by means of ties, hook and loop fastener(s), buckles, snap fittings, latches, poppets, locks or any suitable means.

Preferably, for each first edge there is a complementary second edge.

Preferably, to move from the flat configuration to the erected configuration the/each first edge is brought into engagement with its complementary second edge.

Preferably, in the erected configuration the/each first edge is engaged with its complementary second edge.

Most preferably, in the erected configuration the/each first edge is engaged with its complementary second edge such that one edge overhangs the other edge to at least partially conceal the zip.

In one embodiment releasably connecting the/each first edge to its complementary second edge secures the device body in the erected configuration.

In the erected configuration the zips may be concealed.

BRIEF DESCRIPTION OF THE DRAWINGS

Embodiments of the present invention will now be described with reference to the accompanying drawings in which.

DETAILED DESCRIPTION OF THE DRAWINGS

Figure 1:
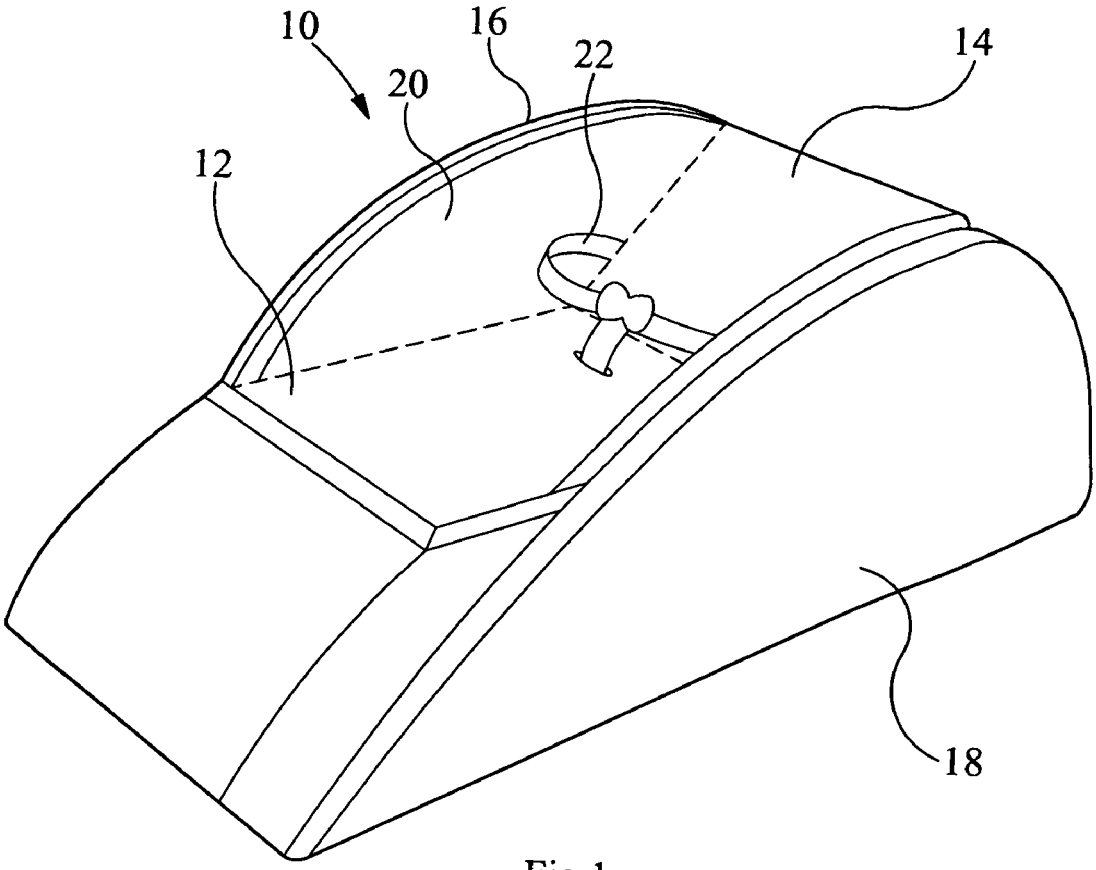
FIG. 1 is a perspective view of a baby support device according to a first embodiment of the present invention.
Figure 2:
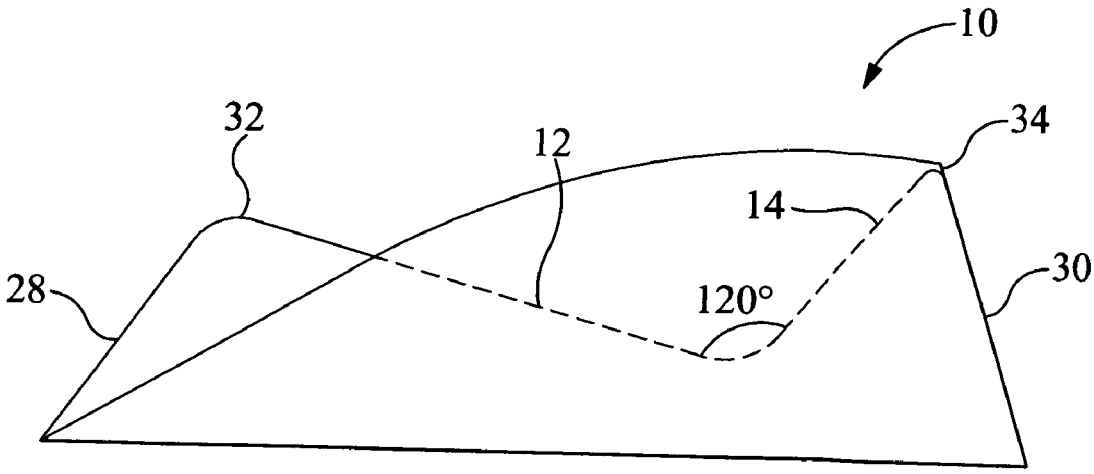
FIG. 2 is a side view of the device of FIG. 1.

Reference is firstly made to FIGS. 1 and 2, perspective and side views of a baby support device, generally indicated by reference numeral 10 according to a first embodiment of the present invention. The baby support device 10 comprises an elongate first surface 12 adapted to support all or part of a baby (not shown) and a shorter second surface 14 adapted to support at least part of a baby. The first and second surfaces 12, 14 are arranged at an angle, in the example shown in FIG. 2, of 120° such that the first surface 12 alone or the first and second surfaces 12, 14 together can, in use fully support a baby in both the prone or supine orientations.

The baby support device 10 further has a front edge 28 and a rear edge 30, the front edge 28 and the first surface 12 defining a front apex 32 and the second surface 14 and the rear edge 30 defining a rear apex 34. As can be seen from FIG. 2 the rear apex 34 is markedly higher than the front apex 32. The second surface 14 slopes more steeply towards the rear apex 34 than the first surface 12 slopes towards the front apex 32. The second surface 14 is at an angle of 15° to the horizontal whereas the first surface 12 is at an angle of 45° to the horizontal.

Figure 3:
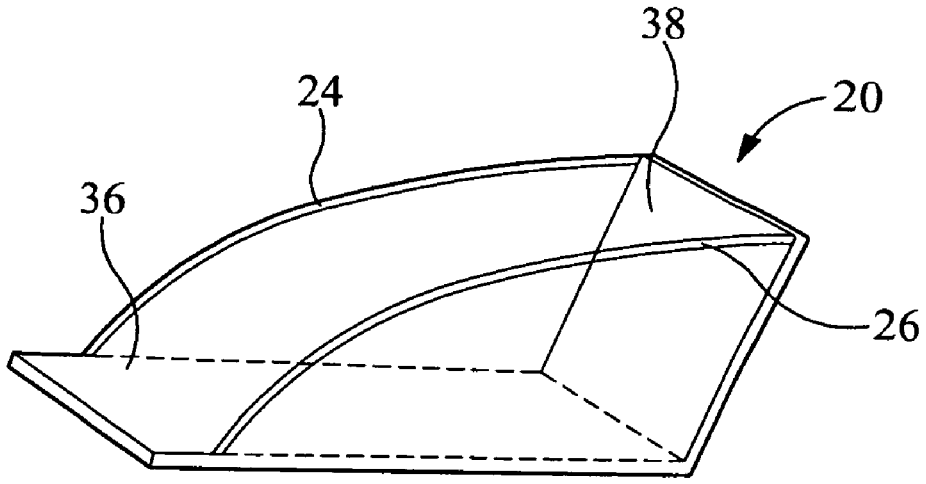
FIG. 3 is a perspective view of the mat of the device of FIG. 1.

The device 10 further includes first and second sides 16, 18 and a mat 20 made from a wipe clean material. The device 10 has a harness 22 to secure a baby to the device 10 if required. The mat can be seen in FIG. 3, a perspective view of the mat 20 of FIG. 1. The mat 20 also has first and second sides 24, 26.

The mat 20 comprises a wipe clean surface 36 filled with foam. It is a single piece construction and the side walls 24, 26 and the back wall 38 fold along the dotted lines shown to form the arrangement shown in FIG. 3. The shape is held by being supported by the first and second surfaces 12, 14 and the first and second sides 16, 18 of the baby support device 10.

Figure 4:
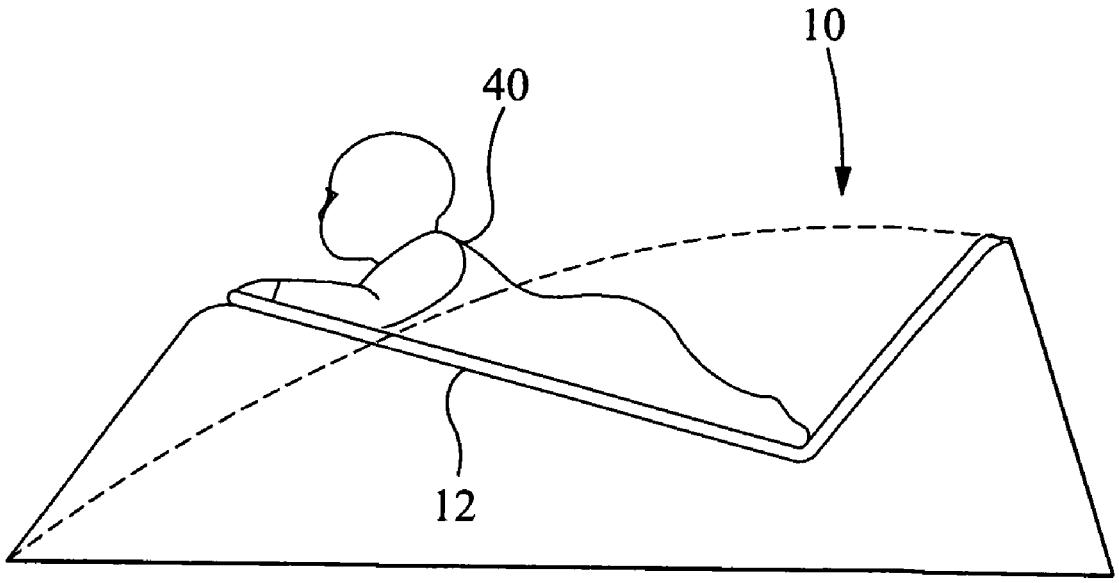
FIG. 4 is a side view of the device of FIG. 1 showing a baby in a first orientation.
Figure 5:
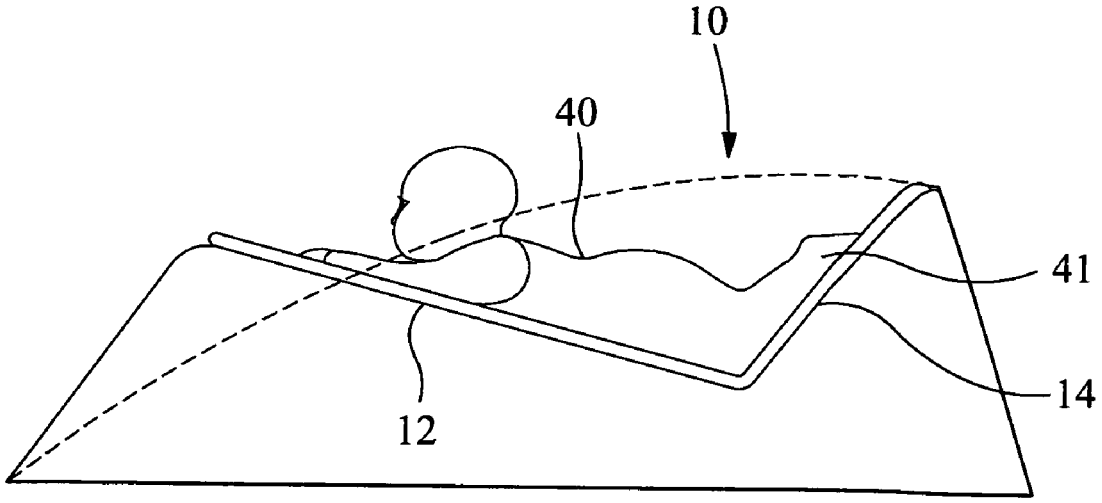
FIG. 5 is a side view of the device of FIG. 1 showing a baby in a second orientation.

FIGS. 4 to 8 show the device 10 of FIG. 1 in use with a baby 40. FIGS. 4 and 5 show the baby 40 in a prone orientation, FIG. 4 showing the baby 40 supported entirely by the first surface 12 and FIG. 5 showing the baby 40 supported by both first surface 12 and the second surface 14. In both cases the baby 40 is fully supported by the device 10. Particularly in FIG. 5, the baby's feet 41 are supported allowing him to kick against the second surface 14 and develop leg muscles and leg strength.

Figure 6:
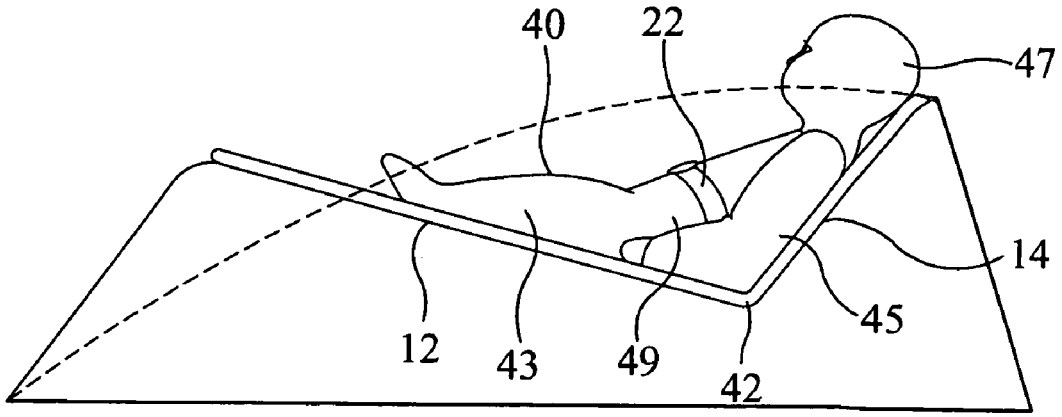
FIG. 6 is a side view of the device of FIG. 1 showing a baby in a third orientation.

FIG. 6 shows a baby 40 in an upright seated position with his legs 43 supported by the first surface 12 and his head 47 and back 45 supported by the second surface 14, the baby's bottom 49 resting in the intersection 42 of the first and second surfaces. The baby 40 is shown secured to the device using the harness 22.

Figure 7:
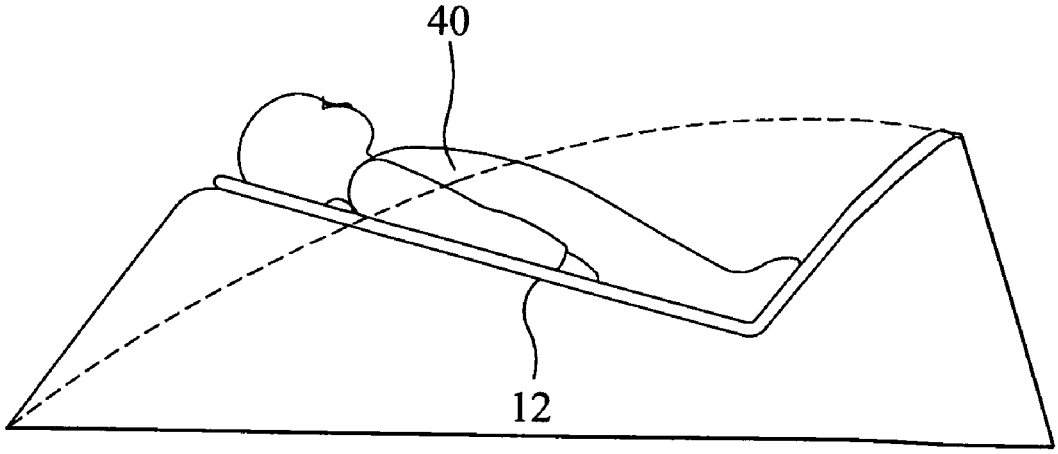
FIG. 7 is a side view of the device of FIG. 1 showing the baby in a fourth orientation.
Figure 8:
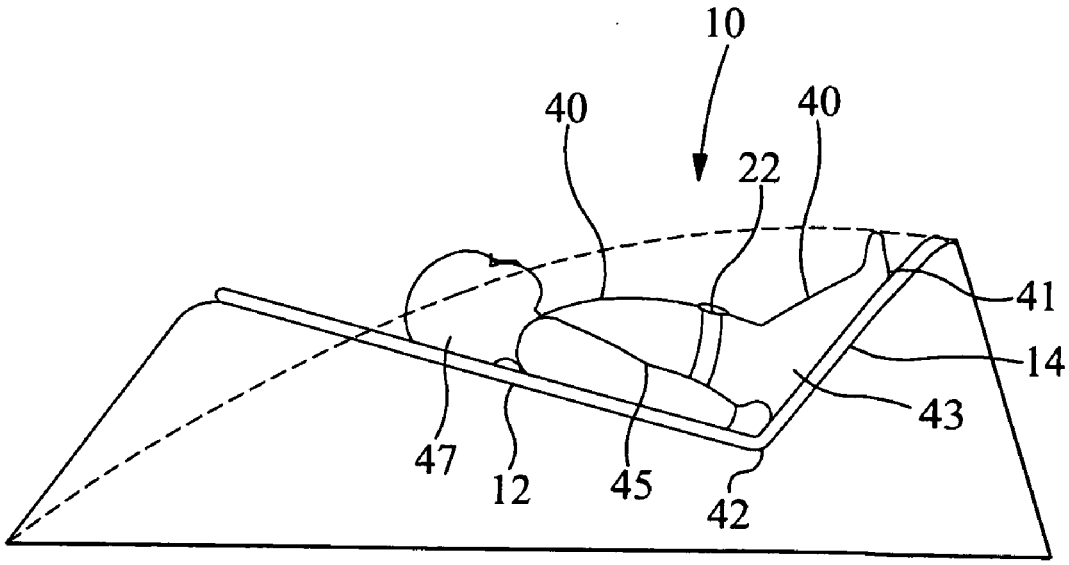
FIG. 8 is a side view of the device of FIG. 1 showing a baby in a fifth orientation.

FIGS. 7 and 8 show a baby in the supine position, in FIG. 7 the baby 40 is fully supported by the first surface 12 and can press his feet 41 against the second surface. It is believed this provides a stimulus to the infant which may lead to walking from a young age. In FIG. 8 the baby's head 47 and back 45 are supported by the first surface 12 and his legs are supported by the second surface 14, the baby's bottom resting in the interface 42 of the first and second surfaces 12, 14. Particularly, the baby's feet 41 are supported allowing him to kick against the second surface 14 and develop leg muscles and leg strength. In FIG. 8 the baby 40 is shown secured to the device using the harness 22.

Figure 9:
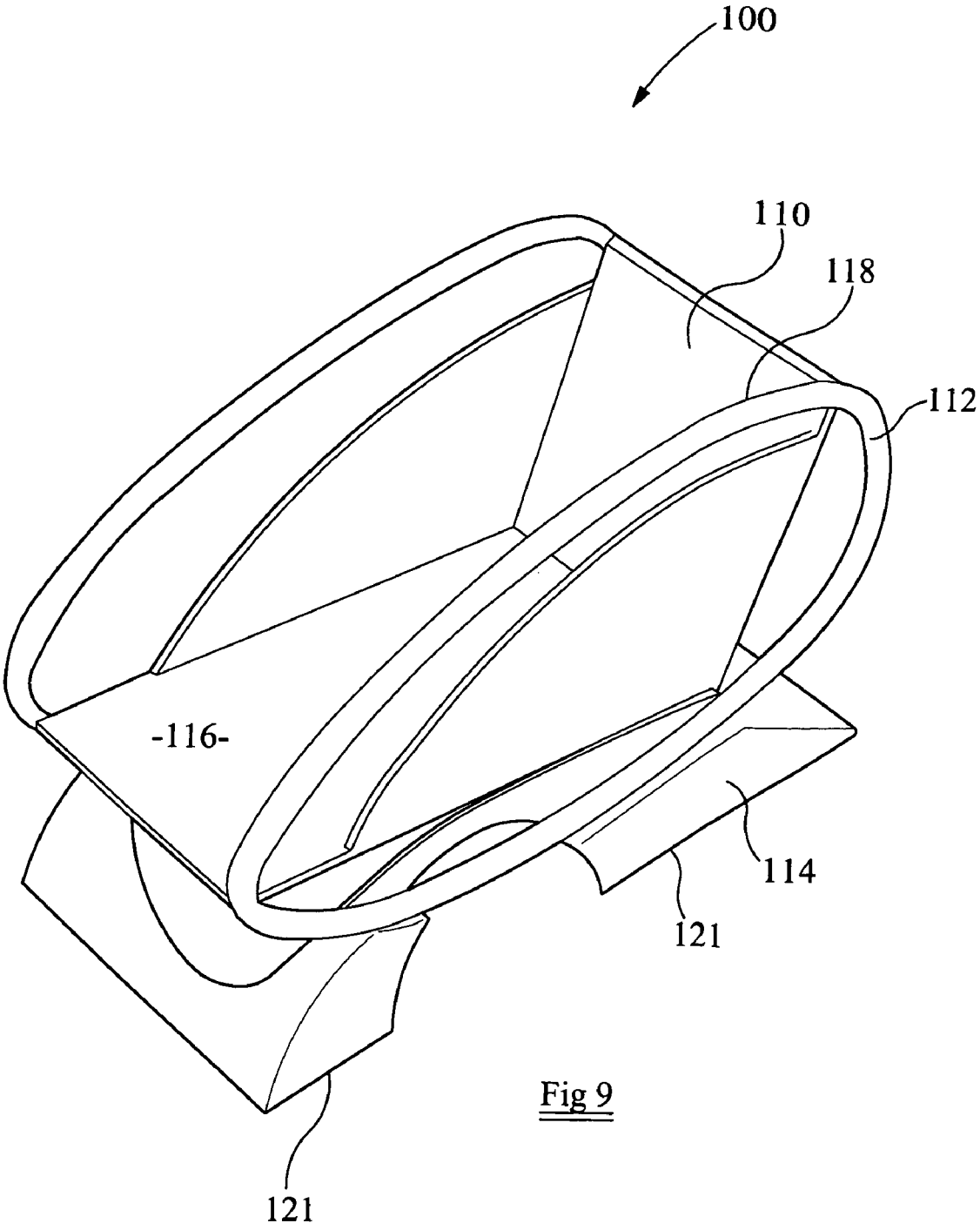
FIG. 9 is a perspective view of a baby support device according to a second embodiment of the present invention in a first configuration.

FIGS. 9 to 12 describe a second embodiment of the present invention. Referring firstly to FIG. 9 there is shown a device, generally indicated by reference numeral 100 for supporting a baby in both the prone or supine orientations, the baby's feet in use being supported in both orientations. The device 100 comprises a body 110, a frame 112 and a polypropylene frame support 114. The body 110 describes an elongate first surface 116 adapted to support all or part of a baby and a shorter second surface 118 adapted to support at least part of a baby, the first and second surfaces 116,118 being at approximately 110° with respect to one another.

In FIG. 9 the device 100 is shown in one or two configurations. In this first configuration the frame support 114 provides a stable base for the frame 112 and the body 110 due to having four ground engaging points 121 which are flat.

Figure 10:
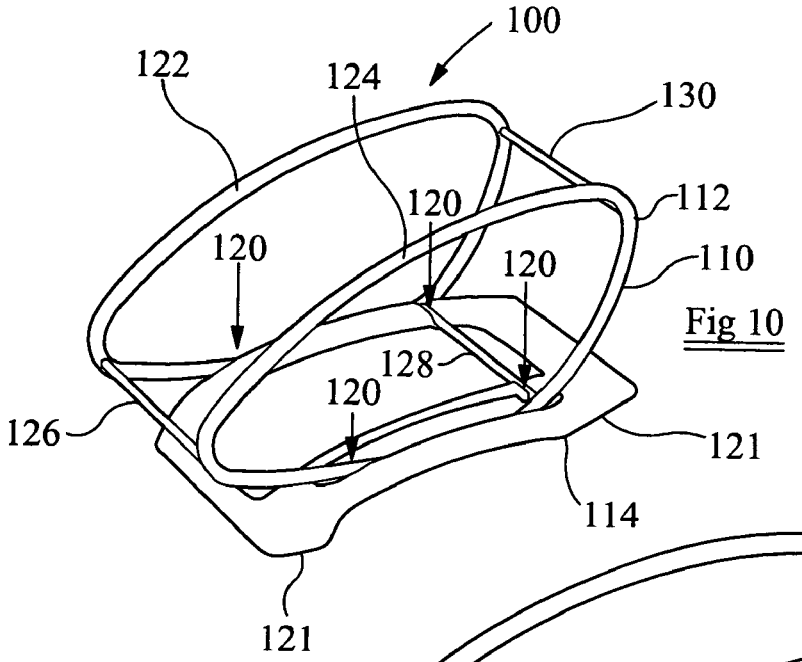
FIG. 10 is a perspective view of part of the baby support device of FIG. 9 in the first configuration.

Referring to FIG. 10, which show a perspective view of part of the device 100 in the first configuration, the body 110 not being shown for clarity, it can be seen that the frame 112 clips into recesses 120 defined by the frame support 114. In this position, the frame 112 is releasably locked with respect to the frame support 114.

As can be seen from FIG. 10, the frame 112 comprises a pair of mild steel side members 122, 124 connected by three cross members 126, 128 and 130. As can be seen from FIG. 10, the second cross member 128 is clipped by a snap fit into the frame support 114 at the rear of the device 100 whereas the first and second side members 122, 124 are clipped into the device 100 at the front of the frame support 114.

Figure 11:
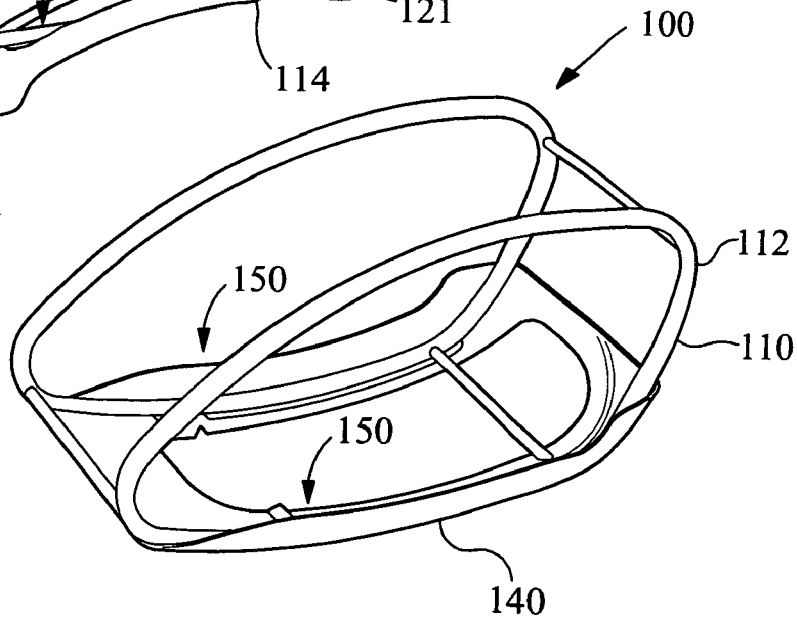
FIG. 11 is a perspective view of part of the baby support device of FIG. 9 in a second configuration.
Figure 12:
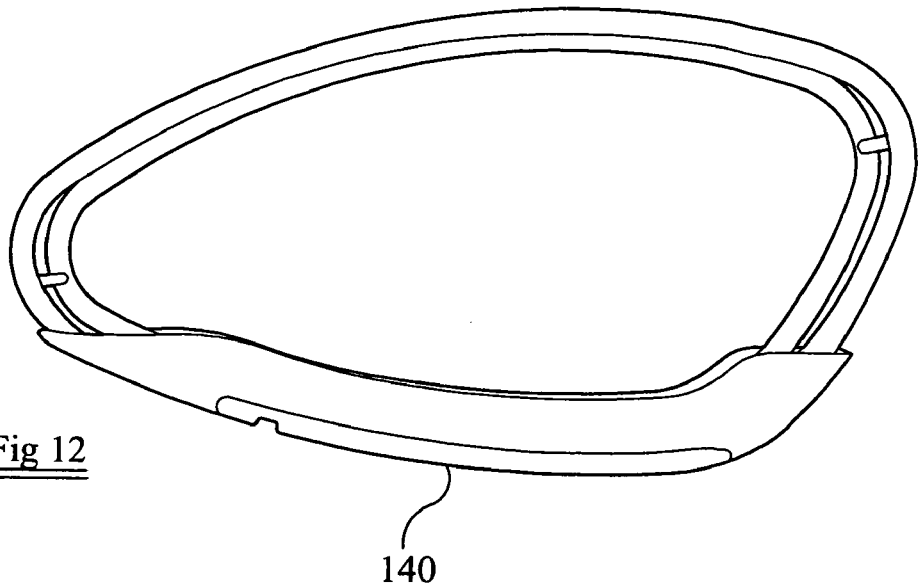
FIG. 12 is a side view of part of the baby support device of FIG. 9 in the second configuration.

Reference is now made to FIGS. 11 and 12 which show part of the device 100, without the body 110, in a second configuration in which the device 100 is adapted to rock. In this configuration the frame support 114 has been inverted from the position shown in FIGS. 9 and 10 such that the frame support curved surface 140 engages the ground.

Again, the frame 112 is clipped into the frame support 114 by attachment points 150 which clip onto the side members 122, 124 permitting the device 100 to be rocked.

Reference is now made to FIGS. 13 to 16 which show views of the baby support device 200 according to a third embodiment of the present invention. The baby support device 200 has the same arrangement of first and second surfaces 212, 214 as the first embodiment, however, it is the construction of the support device 200 which represents the biggest difference between the first and third embodiments.

Figure 13:
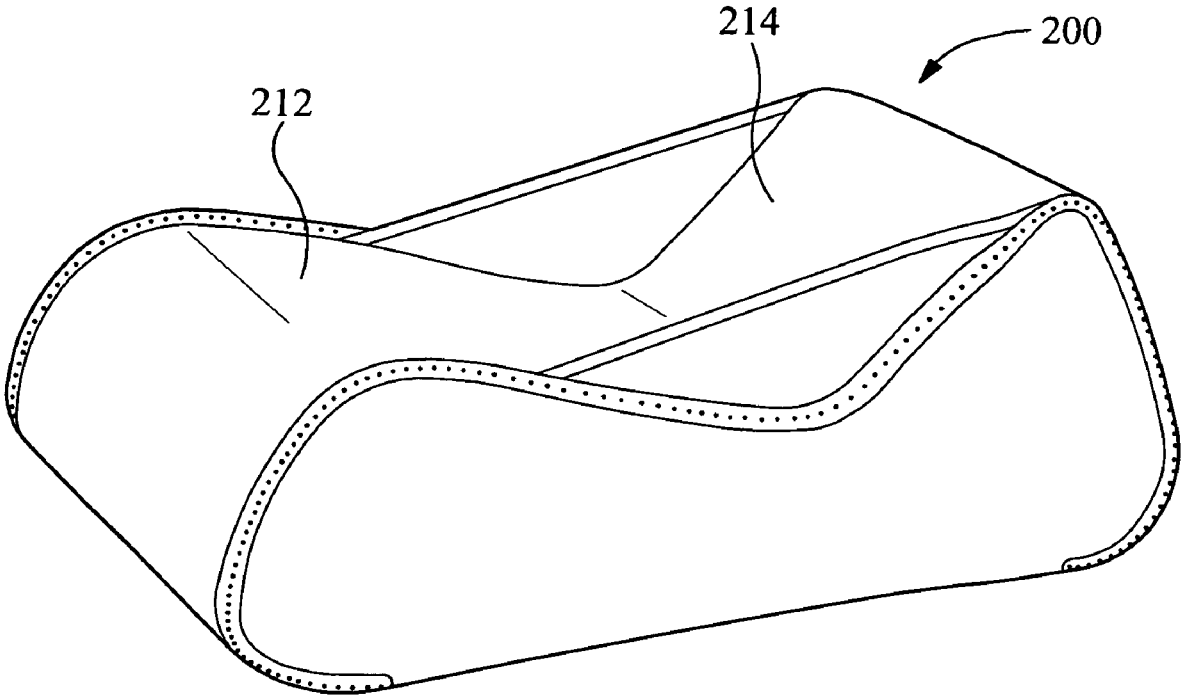
FIG. 13 is a perspective view of a baby support device in an erected configuration according to a third embodiment of the present invention.
Figure 16:
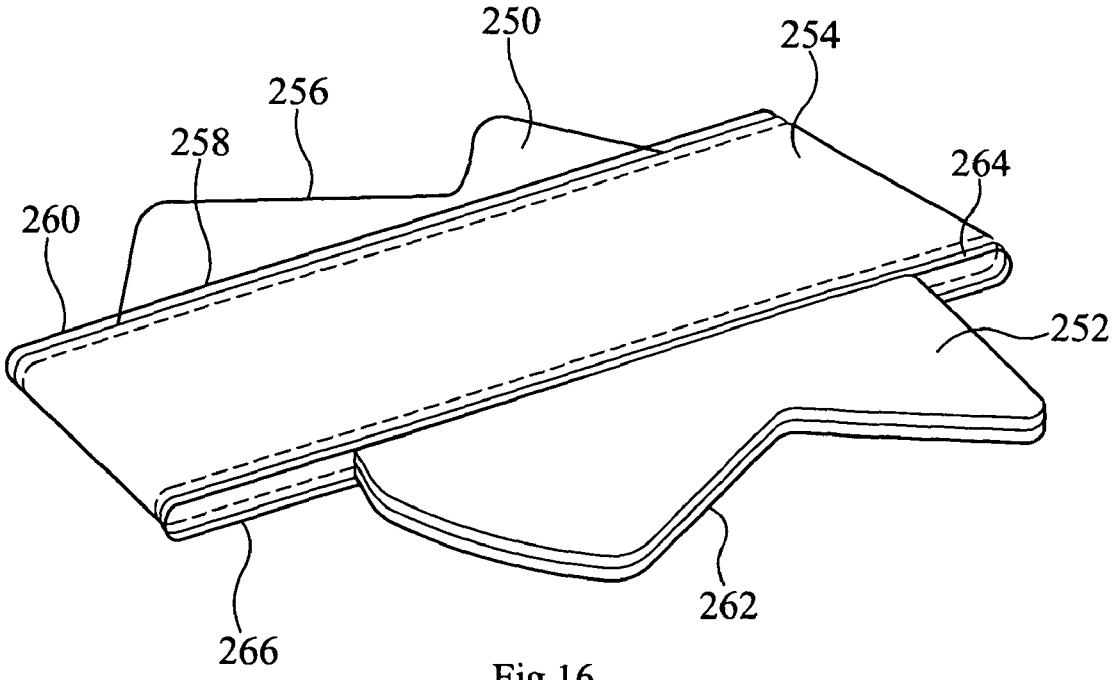
FIG. 16 is a perspective view of the baby support device of FIG. 13 in a collapsed configuration.

Referring to FIG. 16, a perspective view of the baby support device 200 of FIG. 13 in a collapsed configuration, it can be seen that the baby support device 200 can be supplied as a flat pack. The baby support device 200 comprises a first wall 250 and a second wall 252. Between the walls 250, 252 is a centre portion 254 which will define the first and second surfaces 212, 214 once the baby support device 200 is erected.

A first wall edge 256 is adapted to be connected to a centre portion first edge 258 by means of a first zip fastener 260. Similarly a second wall edge 262 is adapted to be connected to a centre portion second edge 264 by means of a second zip fastener 266. The act of bringing the edges together by the zips 260, 266 moves the baby support device 200 from the collapsed configuration shown in FIG. 16 to the erect configuration shown in FIG. 13.

Figure 14:
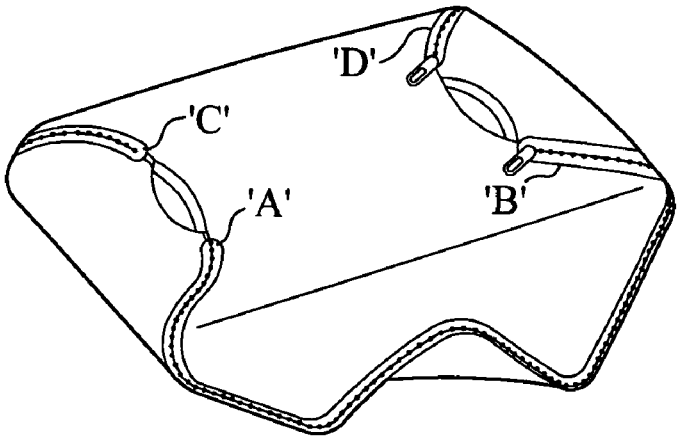
FIG. 14 is an alternative perspective view of the baby support device of FIG. 13.

Referring to FIG. 14, a perspective underside view of the baby support device 200 of FIG. 13, the first zip 260 starts at the position marked "A" and runs to the position marked "B" and similarly the second zip 266 runs from the position marked "C" to the position marked "D".

Figure 15:
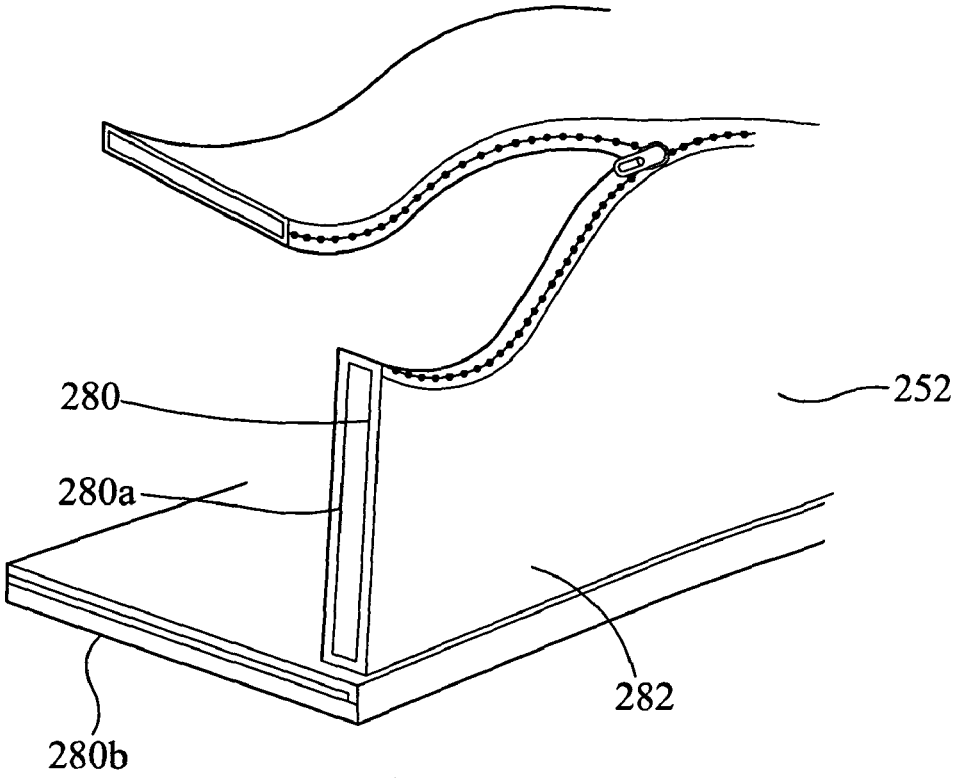
FIG. 15 is a partially cut away perspective view of part of the baby support device of FIG. 13.

Referring now to FIG. 15, the walls and centre portion, 250, 252, 254 comprise a central core manufactured from a polypropylene plastic sheet 280 in a fabric sleeve 282. In this embodiment, the fabric is cotton. As can be seen from FIG. 15 the second side wall core 280*a* is separate from the centre portion core 280*b*, permitting the wall 252 to fold into position with respect to the centre portion with minimal effort.

Various modifications and improvements may be made to the above described embodiments without departing from the scope of the invention. For example, the device of the second embodiment could be provided with a harness like the device of the first embodiment. In alternative embodiments the mat of FIG. 3 may be washable. The mat may comprise a cotton or muslin material. In further embodiments the mat may be disposable.

With reference to the final embodiment in which zip fasteners are provided, the zips may, in alternative embodiments, be displaced slightly away from each centre portion edge so that in the erected configuration the centre portion edge overhangs each wall edge, thereby concealing the zips.

The invention claimed is:

1. A baby's support device comprising an elongate first surface adapted to support all or part of a baby; and a shorter second surface adapted to support at least part of a baby, the first and second surfaces being arranged at an angle with respect to one another such that the first surface alone or the first and second surfaces together can, in use, fully support a baby in both the prone or supine orientations, wherein the device comprises a collapsible body.

2. The device of claim 1, wherein the first and second surfaces are arranged at approximately 110° to one another.

3. The device of claim 1, wherein the elongate first surface is angled at approximately 20° to the horizontal and the shorter second surface is angled at a approximately 50° to the horizontal.

4. The device of claim 1, wherein the mat comprises a wipe-clean material.

5. The device of claim 1, wherein the body defines the first and second surfaces.

6. The device of claim 1, wherein the device further comprises a frame.

7. The device of claim 6, wherein the frame is adapted to support the body.

8. The device of claim 6, wherein the body are releasably connectable to the frame.

9. The device of claim 1, wherein the body is washable.

10. The device of claim 6, wherein the device further includes a frame support.

11. The device of claim 10, wherein the frame support is adapted to receive the frame.

12. The device of claim 10, wherein the frame support is adapted to releasably support the frame.

13. The device of claim 12, wherein the frame support is adapted to releasably support the frame in a first position in which the device is stable or in a second position in which the device is adapted to rock.

14. The device of claim 13, wherein in the first and/or second positions the frame is releasably lockable with respect to the frame support.

15. The device of claim 13, wherein in the second position the frame support is inverted with respect to the first position.

16. The device of claim 1, wherein the device incorporates a first and second side.

17. The device of claim 16, wherein the sides are integral with the device body.

18. The device of claim 1, wherein the device further incorporates a harness.

19. The device of claim 18, wherein the harness, in use, encircles the baby and be fixed to the device.

20. The device of claim 18, wherein the harness is arranged such that, in use, the baby is sandwiched between the harness and the body.

21. The device of claim 1, wherein the device further comprises a mat.

22. The device of claim 21, wherein the mat is padded.

23. The device of claim 22, wherein the mat comprises a wipe clean material.

24. The device of claim 21, wherein the mat is washable.

25. The device of claim 1, wherein the device body comprises a core material contained within a fabric layer.

26. The device of claim 25, wherein the core comprises a plastic sheet.

27. The device of claim 25, wherein beneath the first and second surfaces the core is coated with a cushioned material.

28. The device of claim 27, wherein the cushioned material comprises foam.

29. The device of claim 25, wherein the fabric layer comprises cotton.

30. The device of claim 1, wherein the device body is movable between a flat configuration and an erected configuration.

31. The device of claim 30, wherein the device body is movable between a flat configuration and a folded configuration.

32. The device of claim 31, wherein the device body is movable between a stored configuration and an erected configuration, such that when moving between the stored and erected configurations the device body adopts a flat configuration.

33. The device of claim 1, wherein the device body defines at least one first, edge and at least one second edge.

34. The device of claim 33, wherein one of said first edges is releasably connectable to one of said second edges by a releasable connector.

35. The device of claim 34, wherein the edges are releasably connectable by means of a zip.

36. The device of claim 34, wherein the edges are releasably connectable by means of ties, hook and loop fastener(s), buckles, snap fittings, latches, poppets, locks or any suitable means.

37. The device of claim 26, wherein for each first edge there is a complementary second edge.

38. The device of claim 37, wherein to move from the flat configuration to the erected configuration the/each first edge is brought into engagement with its complementary second edge.

39. The device of claim 38, wherein in the erected configuration the/each first edge is engaged with its complementary second edge.

40. The device of claim 39, wherein releasably connecting the/each first edge to its complementary second edge secures the device body in the erected configuration.

* * * * *